US006503065B2

(12) United States Patent
Tanaka et al.

(10) Patent No.: US 6,503,065 B2
(45) Date of Patent: Jan. 7, 2003

(54) ENGINE BLOWER

(75) Inventors: Kohya Tanaka, Narashino (JP); Tetsuji Shibata, Yachiyo (JP)

(73) Assignee: Tanaka Kogyo Co., Ltd., Narashino (JP)

( * ) Notice: Subject to any disclaimer, the term of this patent is extended or adjusted under 35 U.S.C. 154(b) by 37 days.

(21) Appl. No.: 09/777,440

(22) Filed: Feb. 6, 2001

(65) Prior Publication Data

US 2002/0106289 A1 Aug. 8, 2002

(51) Int. Cl.[7] ..... F04B 39/06
(52) U.S. Cl. ..... 417/366
(58) Field of Search ..... 417/366, 368, 417/372

(56) References Cited

U.S. PATENT DOCUMENTS 6,116,864 A * 9/2000 Veser et al. ..... 417/366

FOREIGN PATENT DOCUMENTS

JP 3-10176 3/1991

JP 5-79494 3/1993

* cited by examiner

*Primary Examiner*—Michael Koczo
(74) *Attorney, Agent, or Firm*—Frishauf, Holtz, Goodman & Chick, P.C.

(57) ABSTRACT

An engine blower with excellent engine cooling capacity and sufficient efficiency in restraining noises without deteriorating the blower performance is offered. A fan provided with vanes to create the wind for the blower and the wind for cooling the engine on both side of the rotating plate is rotated inside the blower case in order to cool the engine, the air in the engine case provided with an air inlet port is suctioned into the blower case from the inlet provided on the wall separating the engine case and the blower case by utilizing the negative pressure created by rotation of the fan, the cylinder inside the engine case is cooled by the air passing from the air inlet port to the blower case via the engine case, and the engine noise emitted to the outside from the air inlet port from the engine case is minimized by passing the air in the engine case to the blower case from the air inlet port.

2 Claims, 3 Drawing Sheets

ENGINE BLOWER

BACKGROUND OF THE INVENTION AND RELATED ART STATEMENT

This invention is related to an improvement made to engine blowers, which are used to gather fallen leaves and cut grasses, by rotating a fan by an engine and blowing out the air suctioned into the blower case from the outlet port.

In the prior art, there are known engine blowers of this type constructed in such a way that a fan inside the blower case is rotated by driving the engine, the air suctioned through a suction port of the case is turned in vortex to raise its pressure and then jetted from the outlet port.

The problem of how to cool the engine faced by this type of blowers was resolved generally by guiding a part of the air suctioned into the blower case to an inlet port provided at one end of the engine case and passing the air out through an outlet port provided at the other end of the engine case, thereby cooling the engine by this flow of the air.

A similar means of cooling an engine is disclosed in Japanese Patent Kokai Publication Hei 5-79494 wherein openings are provided on the upstream and the downstream sides in the blower case that are connected respectively to the engine case, and the engine is cooled by passing into the engine case through the opening on the upstream side a part of the air introduced into the blower by rotating a blower fan, stirring the air by a cooling fan inside the engine, and returning the air into the blower case through the opening on the downstream side.

Another means of cooling the engine is disclosed in Japanese Utility Model Publication Hei 3-10176 wherein a blower fan provided with vanes on both sides of rotor disk in a freely rotatable fashion in the blower case to impart the air blowing function and the blower case performing its original function of jetting the air suctioned from the main suction port through the outlet port as well as the function of charging a part of the air suctioned from another suction port into the engine case, to thereby cool the engine and then exhaust the air out of the engine case.

This engine blower is provided with a suction port on the wall separating the blower case and the engine case and another suction port adjacent to and connecting to said suction port of the engine case as a means to pass a part of the suction air to the engine case to thereby cool the engine. By rotating the fan inside the blower case, the air outside the engine case is introduced into the blower case through said two suction ports, becomes a high pressure air flow in the blower case and then is passed into the engine case again through another port provided elsewhere on said wall. The airflow charged into the engine case cools the engine as it passes around the cylinder and then is emitted outside through an exhaust port provided at one portion of the engine case.

Of the prior art engine blowers discussed above, a construction wherein a part of the air suctioned into the blower case is introduced into the engine case and the air cools the engine as it passes toward the exhaust port of the engine case is defective in that when the cooling air is emitted out of the exhaust port, the engine exhaust noise and the fan noise are also emitted through the exhaust port, causing nuisances.

The engine blower according to Japanese Patent Kokai Publication Hei 5-79494 has the openings on the windward and the leeward sides on the wall separating the blower case and the engine case that are positioned parallel to each other at equal distance from the rotary shaft of the fan on the circumference in the area receiving the same air pressure. Generally speaking, the air inside the blower case is turned in vortex by rotation of the blower fan, so that the pressure in the outer peripheral region inside the blower case becomes higher and that in the center region becomes negative. In the engine blower mentioned above, however, both of the two openings on the windward and the leeward sides are provided in the outer peripheral region of the blower case where the pressure is high.

When the two openings on the windward and the leeward sides are provided in the outer peripheral region of the blower case where the pressure is high, the air from the windward side in the blower case where the pressure is higher passes through the opening into the engine case where the pressure is low, and cools the engine in the process. However, it is difficult for the air in the engine case to pass into the blower case from the opening on the leeward side because the pressure in the blower case is higher than that in the engine case This prevents optimum cooling of the engine.

On the other hand, the engine blower according to said Japanese Utility Model Publication Hei 3-10176 has an exhaust port for the air, which has cooled the engine on the side of the engine case. Thus, the engine noise is directly emitted outside through the exhaust port with the air that has cooled the engine, creating difficulties in controlling the noise. Since one side of the blower fan in the blower case is used to generate the air for cooling the engine, which function is irrelevant to the original function of the blower, the volume in the blower case to be used for its original purpose is decreased to thereby decrease the volume of air suctioned through the main suction port of the blower case and to deteriorate the blower performance.

Having analyzed the problems encountered by the prior art engine blowers as mentioned above, we found out that the reasons why the conventional type engine blowers create excessive noises or why the blower performance cannot be maximized are because the conventional engine blower attempts to cool the engine with the air passage from the engine case to the outside created by the wind pressure generated in the blower.

SUMMARY OF THE INVENTION

The present invention aims to obviate the above-mentioned problems of conventional engine blowers and to offer an engine blower, which demonstrates an excellent engine cooling performance, and sufficiently restrains noises.

The technical features of the present invention lie in that the negative pressure on the suction side of the blower is utilized to pass the outside air to the direction where the air is positively suctioned into the engine case and the engine is cooled in this passage of the air.

In an engine blower wherein a fan inside a blower case is rotated by driving the engine provided on one side of the blower case, the air is suctioned into the blower case from a main suction port, and the air in the blower case is jetted through an outlet port provided on the outer periphery of the blower case, the present invention provides a fan having vanes to generate the wind for the blower and vanes to generate the wind to cool the engine that is axially mounted inside the blower case in a freely rotatable fashion, an inlet port near the center of the fan on the wall separating the engine case and the blower case, and an air suction port at one end of the passage for passing the air from the engine case toward the inlet port on said wall while contacting the air with the engine cylinder, to thereby cool the engine by the air suctioned into the engine case by the negative pressure on the suction side inside the blower case.

The inlet port in the engine case should preferably be provided opposite to the inlet port on the wall separating the engine case and the blower case on the line leading to the cylinder.

According to another embodiment of the present invention, the engine case ceiling is raised high to include the outer periphery of the blower case and an air inlet port is provided on the outer periphery of the blower case that is covered by the ceiling to supply the compressed air generating in the blower case into the engine case. This forms an air passage on the inside of the ceiling connecting with said air inlet, and a through hole is bored in the air passage in order to introduce the air from above the cylinder into the engine case. In this embodiment, the air passage provided on the inside of the ceiling should preferably be shaped such that the air introduced from the inlet port at one end is sent to the direction of the through hole at the other end by providing a horizontal guide plate extending from the outer periphery of the blower case to the inside of the engine case at the upper end of the wall separating the engine case and the blower case.

In the present invention engine blower, the high-pressure air is generated at the outer periphery of the blower case by rotation of the fan in the blower case and is jetted from the outlet port. At the center of the fan in the blower case is generated negative pressure, which causes the outside air to be suctioned through the main suction port. As the fan is provided with vanes to generate the wind for the blower on one side and vanes to generate the wind for cooling the engine on the other side, the air is respectively suctioned through the main suction port in the blower case and the inlet port provided on the wall separating the engine case and the blower case.

The air suctioned into the blower case through the main suction port is compressed inside the case and jetted through the outlet port to perform the original role of the blower, whereas the air suctioned into the blower case through the inlet port on the wall is the air of the engine case, so that there is created an air flow from the suction port toward the inlet port on the wall.

Since the air inlet port is provided at one end of the passage to pass the air in the engine case toward the inlet port of said wall while contacting the engine cylinder, there is generated an air passage from the suction port in the engine case moving toward the inlet port while contacting with and cooling the engine cylinder. The air suctioned into the blower case from the inlet port is emitted through the outlet port with the air suctioned into the blower case from the main suction port in order to perform the intended role of the blower.

DETAILED DESCRIPTION OF THE PREFERRED EMBODIMENTS

Figure 1:
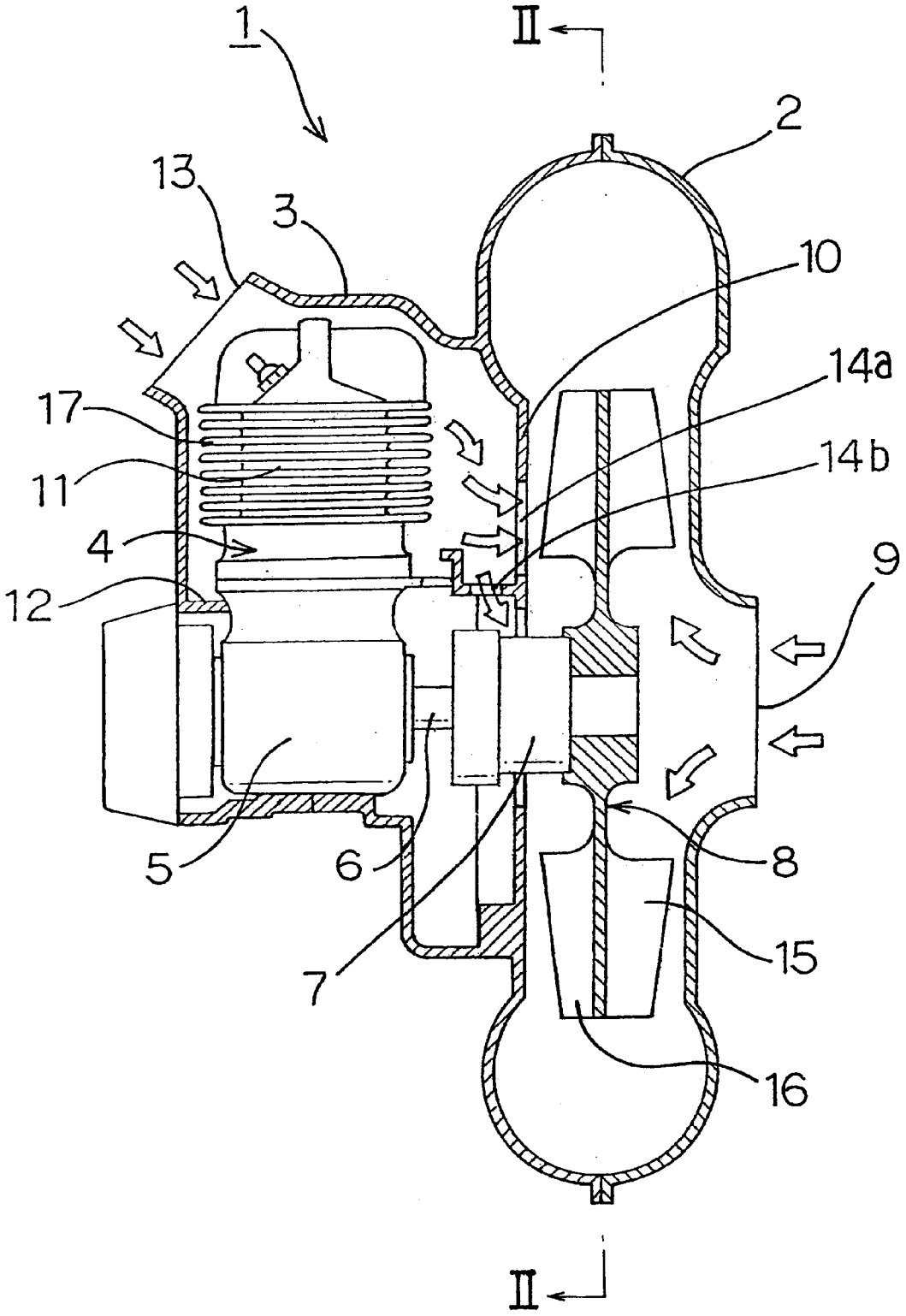
FIG. 1 is a cross sectional view showing the construction of one embodiment of the present invention engine blower.
Figure 2:
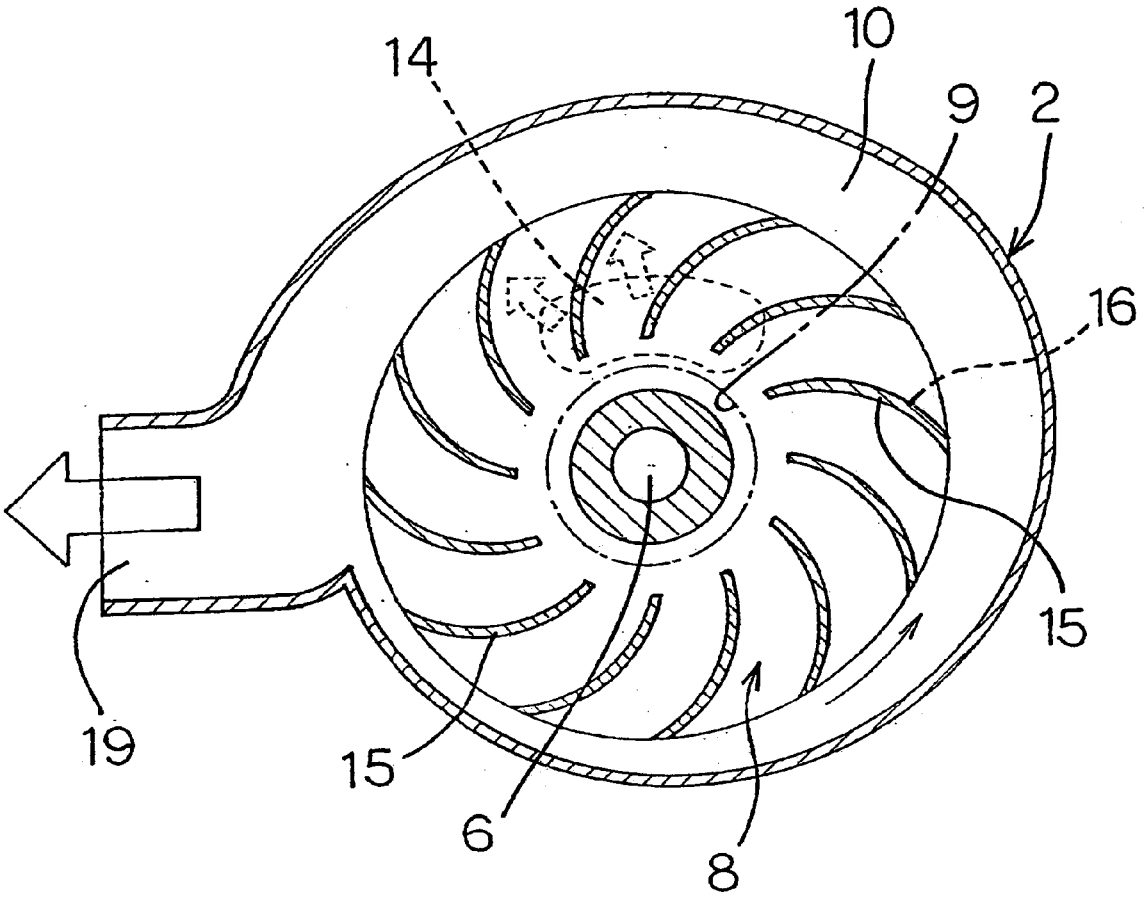
FIG. 2 is a cross sectional view along the line II—II of FIG. 1.

The construction of an engine blower according to the present invention is described by referring to the embodiment shown in FIG. 1. The engine blower comprises a blower case 2 formed integrally with an engine case 3. The engine case 3 covers an engine 4. A drive shaft 6 extends from the crank chamber 5 of the engine 4 in the engine case 3 into the blower case 2 via a rotation-transmitting member 7 such as a centrifugal clutch, and a fan 8 is axially mounted on the end of said drive shaft 6 in the blower case 2. Said blower case 2 has a main suction port 9 opposite to the side mounted with the engine case 3, and when the fan 8 in the blower case 2 is rotated by said engine 4, the air is suctioned into the blower case 2 from said suction port 9, turned and compressed inside the blower case 2, and jetted from an outlet port 19 provided at one end of the outer periphery of the blower case 2.

The engine case 3 is separated by a vertical wall 10 from the blower case 2. The engine 4 includes a cylinder 11, a crank chamber 5, etc. The crank chamber 5 and the cylinder 11 are separated by a horizontal wall 12 connected to the blower case 2 at one end thereof to cover the cylinder 11.

The fan 8 provided in the blower case 2 has vanes 15 to generate the wind for the blower on one side of the rotating plate 8*a* and vanes 16 to generate the wind for cooling the cylinder 11 on the opposite side of the plate, and the air is suctioned into the blower case 2 through the main suction port 9 when the fan 8 is rotated.

Said engine case 3 has a port 14*a* to suction the air in the engine case 3 having the cylinder 11 into the blower case 2 at the center of the wall 10 separating the blower case 2. Said horizontal wall 12 also has a port 14*b* to suction the air of the engine case 3 having the cylinder 11 into the blower case 2 through the interstice of the crank chamber 5 and the rotation-transmitting member 7. Inside the engine case 3 is provided an air inlet port 13 to suction the outside air into the engine case 3 at one end of the passage through which the air of the case 3 passes toward the ports 14*a*, 14*b* while contacting with the engine cylinder 11. The port 13 should preferably be positioned on the side opposite to the port 14*a* on the line connecting the cylinder 11 and the port 14*a*.

In the engine blower according to this embodiment, when the engine 4 is rotated, the vanes 15, 16 of the fan 8 connected to the drive shaft 6 are also rotated so that the air is suctioned into the blower case 2 through the main suction port 9, turns in vortex inside the blower case 2, and is jetted through an outlet port 19 provided on the outer periphery of the blower case 2. When the air is being jetted from the outlet port 19, the pressure is higher at the outer periphery of the blower case 2, but is lower in the center region where the suction port 9 is positioned.

The fan 8 in the blower case 2 has vanes 16 on the side facing the wall 10 bordering the engine case 3. Because of the inlet ports 14*a*, 14*b* provided on the wall 10 and connecting with the inside of the engine case 3, there is generated negative pressure in the center region of the blower case 2 by rotation of the vanes 16, and the air in the engine case 3 passes into the blower case 2 through the ports 14*a*, 14*b*. As a result, the air passes into the engine case 3 from the port 13 provided at one part of the engine case 3.

As this engine blower suctions the air from the port 13 into the engine case 3 by the negative pressure generated in the blower case 2, there is formed inside the engine case 3 a smooth air passage from the side of the cylinder 11 toward the blower case 2 through the ports 14*a*, 14*b*, and the engine is adequately cooled as the fresh air constantly contacts surface fins 17 of the cylinder 11. The air suctioned into the blower case 2 through the inlets 14*a*, 14*b* is jetted through the outlet port 19 with the air suctioned into the blower case 2 from the main suction port 9 in order to perform the original function of the blower.

Since the air flowing into the engine case 3 from the above mentioned port 13 is suctioned into the blower case 2 from the ports 14*a*, 14*b*, the noise of the rotating engine 4 generating in the engine case 3 is also suctioned with the air into the blower case 2. As a result, the air inlet port 13 acts mainly as a passage for drawing the outside air into the engine case, and the noises in the engine case 3 hardly go out from the port 13, to thereby radically decrease the engine noise.

Figure 3:
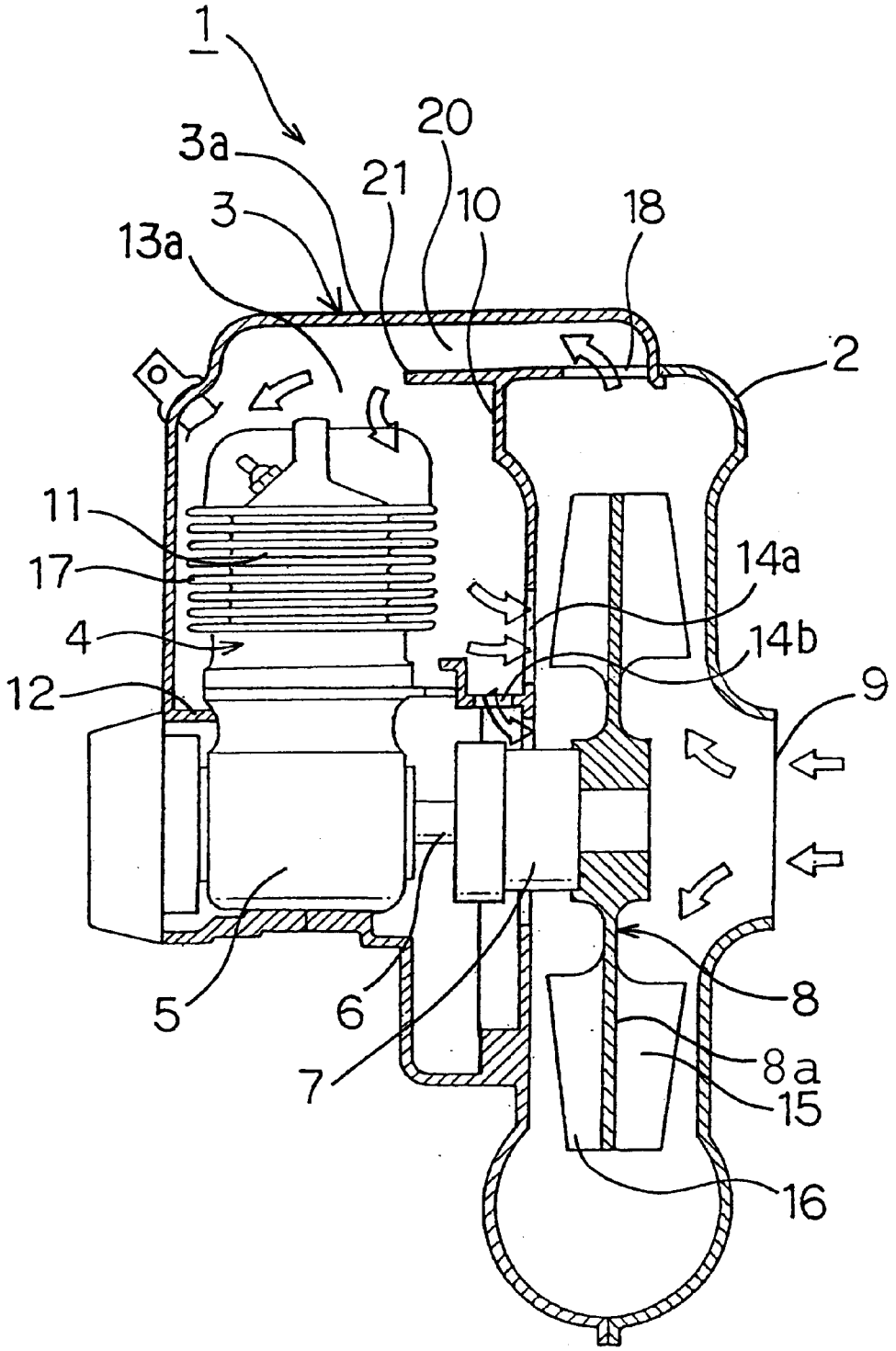
FIG. 3 is a cross sectional view showing another embodiment of the present invention, particularly the parts identical to those shown in FIG. 1.

FIG. 3 shows another embodiment of the present invention engine blower. This blower is essentially the same in construction as the embodiment shown in FIG. 1 in that it has vanes 15, 16 on both sides of a fan 8, the blower case 2 has a main suction port 9, walls 10, 12 separating the cases have inlet ports 14*a*, 14*b*, and a through hole 13*a* corresponding to the air inlet port 13 for the engine blower of FIG. 1 is provided at one part of the engine case 3 where one end of the passage is situated, through which the air in the engine case 3 flows toward said inlet ports 14*a*, 14*b* while contacting the cylinder The engine case 3 shown in FIG. 3 has a very high ceiling 3*a* to enclose the outer periphery of the blower case 2, and an inlet port 18 at one part of the outer periphery of the blower case 2 covered by the ceiling 3*a* in order to supply the compressed air generated in the blower case 2 into the engine case 3 from the port 18.

At the upper end of the wall 10 on the inside of the ceiling 3*a* is provided a horizontal guide plate 21 extending from the outer periphery of the blower case 2 into the engine case 3 to form an airpassage 20 on the inside of the ceiling 3*a* connecting with said port 18, and said through hole 13*a* is provided above the cylinder 11 at the other end of the passage 20.

High pressure air generated at the outer periphery of the blower case 2 flows out of the outlet port 19 and a portion of the air flows into the engine case 3 from the inlet port 18 by way of the passage 20 and the through hole 13*a*. On the other hand, the air in the engine case 3 is suctioned into the blower case 2 through the inlet ports 14*a*, 14*b* by the negative pressure generated at the center of the blower case 2, and the cylinder 11 is cooled by the air flowing from the through hole 13*a* to the inlet ports 14*a*, 14*b* and passing through the engine case 3.

As described above, the present invention engine blower provides vanes on the side of the partitioning wall of the fan rotating inside the blower case as well as an inlet port connecting with the engine case on the wall opposite the vanes. The air in the engine case is therefore suctioned into the blower case by the negative pressure generating at the center of the blower case, and the air suctioned into the engine case from the inlet port efficiently cools the cylinder as it passes smoothly toward the inlet port of the wall inside the engine case.

As the air suctioned into the engine case from the air inlet port is used to cool the cylinder, guided into the blower case from the inlet port of the wall, and emitted from the outlet port of the blower case, the noise of the engine going out of the suction side is very much reduced.

This invention engine blower discharges the air for cooling the cylinder from the outlet port in order to achieve the expected purpose of the blower, so that the work efficiency is improved without decreasing the volume of the wind from the blower or increasing the weight and volume of the device.

What is claimed is:

1. An engine blower comprising:

a blower case;

an engine case separated from the blower case by a wall;

an engine provided in said engine case;

a fan axially mounted in said blower case to be driven by the engine;

a main suction port through which air is suctioned into the blower case;

a first air inlet port provided near a center of the fan on the wall separating the engine case and the blower case for suctioning air from the engine case into the blower case;

an outlet port provided on an outer periphery of the blower case through which the air in the blower case is jetted;

wherein the fan comprises a rotating plate and vanes on both sides of the rotating plate for generating wind for the engine blower and wind for cooling the engine;

wherein a ceiling of the engine case is set high to include the outer periphery of the blower case, wherein a second air inlet port is provided on a part of the outer periphery of the blower case covered by the ceiling to supply compressed air generated in the blower case to the engine case, wherein an air passage connecting with the second air inlet port is formed on an inside of the ceiling, and wherein a through hole is provided in the air passage to introduce air into the engine case from above the cylinder.

2. The engine blower as claimed in claim 1, wherein the air passage provided on the inside of the ceiling is formed such that air suctioned from the second air inlet port at one end is passed toward the through hole at the other end by providing a horizontal guide plate at an upper end of the wall separating the engine case and the blower case, and wherein the guide plate extends from the outer periphery of the blower case toward inside of the engine case.

* * * * *